US005723425A

United States Patent [19]

Cauwberghs et al.

[11] Patent Number: 5,723,425

[45] Date of Patent: Mar. 3, 1998

[54] CONCENTRATED AQUEOUS LIQUID DETERGENT COMPRISING POLYVINYLPYRROLIDONE

[76] Inventors: Serge Gabriel Pierre Cauwberghs; Ivan Maurice Alfons Herbots, both of Procter & Gamble European Technical Center N.V. 100 Temselaan, B-1853 Strombeek-Bever, Belgium

[21] Appl. No.: 699,175

[22] Filed: Aug. 19, 1996

Related U.S. Application Data

[63] Continuation of Ser. No. 360,764, Dec. 22, 1994, abandoned.

[30] Foreign Application Priority Data

Jul. 3, 1992 [EP] European Pat. Off. ..... 92870098

[51] Int. Cl.[6] ..... C11D 1/29; C11D 1/66; C11D 3/386

[52] U.S. Cl. ..... 510/299; 510/300; 510/321; 510/322; 510/337; 510/360; 510/358; 510/470; 510/472; 510/499; 510/500

[58] Field of Search ..... 510/299, 300, 510/321, 322, 337, 360, 358, 470, 472, 499, 500

[56] References Cited

U.S. PATENT DOCUMENTS

| | | | |
|---|---|---|---|
| 3,970,594 | 7/1976 | Claybaugh et al. | 252/524 |
| 3,979,339 | 9/1976 | Claybaugh et al. | 252/524 |
| 4,163,732 | 8/1979 | Sai et al. | 252/99 |
| 4,304,680 | 12/1981 | Wixon | 252/114 |
| 4,594,292 | 6/1986 | Hull et al. | 252/542 |
| 4,756,489 | 7/1988 | Weber et al. | 252/542 |
| 4,999,129 | 3/1991 | Hull | 252/174.17 |
| 5,174,927 | 12/1992 | Honsa et al. | 252/543 |
| 5,234,617 | 8/1993 | Hunter et al. | 252/102 |
| 5,248,434 | 9/1993 | Nicholson et al. | 252/95 |
| 5,312,561 | 5/1994 | Hashino et al. | 325/174.12 |
| 5,604,194 | 2/1997 | Cauwbergh | 510/325 |

FOREIGN PATENT DOCUMENTS

| | | |
|---|---|---|
| 1117843 | 2/1982 | Canada . |
| 0576777 | 1/1994 | European Pat. Off. . |
| 0576778 | 1/1994 | European Pat. Off. . |

*Primary Examiner*—Paul Lieberman
*Assistant Examiner*—Kery A. Fries
*Attorney, Agent, or Firm*—Jacobus C. Rasser; Jerry J. Yetter; Ken K. Patel

[57] ABSTRACT

The present disclosure relates to a concentrated aqueous liquid detergent composition containing polyvinylpyrrolidone, especially capable to provide superior color maintenance to the washed fabrics, in which the anionic surfactant majorily consists of an alkyl ethoxy sulfate.

4 Claims, No Drawings

CONCENTRATED AQUEOUS LIQUID DETERGENT COMPRISING POLYVINYLPYRROLIDONE

This is a continuation of application Ser. No. 08/360,764, filed on Dec. 22, 1994, now abandoned.

TECHNICAL FIELD

The present invention relates to concentrated aqueous liquid detergent compositions containing polyvinylpyrrolidone, in which the anionic surfactant majorily consists of an alkyl ethoxy sulfate salt.

BACKGROUND OF THE INVENTION

It is widely known in the art to use various polymers in liquid detergent compositions. The use of polyvinyl pyrrolidone in detergent compositions, mainly for fabric care properties, has been described for instance in EP 262 897, EP 327 927 and EP 203 486. These documents encompass the use of polyvinylpyrrolidone in liquid detergent compositions.

A new trend in the field of detergent compositions is the formulation of so-called concentrated detergents. In the context of liquid aqueous detergents, this refers to products comprising less water and a higher total amount of active ingredients.

There is a need to provide concentrated detergent compositions which are able to provide superior color maintenance to the washed colored fabrics, that is compositions wherein polyvinylpyrrolidone provides an optimum efficiency as a dye transfer inhibitor agent.

It has now surprisingly been found that such an optimum efficiency of polyvinylpyrrolidone can be achieved in the present concentrated aqueous liquid detergent matrix, when the anionic surfactant in said matrix majorily consists of an alkyl ethoxy sulfate salt.

It has also been found that such a surfactant system improves stability of enzymes such as cellulase, in presence of protease.

SUMMARY OF THE INVENTION

The present invention is directed to liquid detergent compositions comprising an anionic surface-active agent, and from 2% to 35% by weight of the total composition of water, characterized in that the anionic surfactant contains at least 70%, preferably from 75% to 100% by weight of a water-soluble $C_{11-15}$ alkyl ethoxy sulfate salt containing an average per mole of from 1 to 9 ethoxy groups and that the composition comprises from 0.05% to 5% by weight of the total composition of polyvinylpyrrolidone.

The compositions preferably contain less than 6% by weight of the total composition of alkyl benzene sulfonate salt or non-ethoxylated alkyl sulfate salt.

DETAILED DESCRIPTION OF THE INVENTION

The compositions according to the present invention are concentrated liquid detergents which comprise from 2% to 35% by weight of the total composition of water.

Preferred compositions according to the present invention comprise from 5% to 25% by weight of the total composition of water.

The compositions according to the invention contain from 0.05% to 5% by weight of polyvinlypyrrolidone, preferably from 0.25% to 2%. Preferred polyvinylpyrrolidone for use herein have a molecular weight of from 1000 to 100,000, preferably from 2500 to 30,000, most preferably from 5000 to 15,000.

The compositions according to the present invention comprise a surfactant, and in particular an anionic surface active agent.

In the compositions of the present invention, it is essential that the anionic surfactant (hereafter meant as not including soaps) contains at least 70% by weight of said anionic surfactant, of a water soluble $C_{11-15}$ alkyl ethoxy sulfate salt containing an average of from 1 to 9 ethoxy groups per mole.

The $C_{11}$–$C_{15}$ alkyl ethoxy sulfate salt herein comprises a primary alkyl ethoxy sulfate derived from the condensation product of a $C_{11}$–$C_{15}$ alcohol with an average of up to 9 ethylene oxide groups. $C_{13}$–$C_{15}$ alkyl ethoxy sulfate with an average of two to three ethoxy groups per mole is preferred.

The $C_{11}$–$C_{15}$ alcohol itself can be obtained from natural or synthetic sources. Thus, $C_{11}$–$C_{15}$ alcohols, derived from natural fats, or Ziegler olefin build-up, or OXO synthesis can form suitable sources for the alkyl group. Examples of synthetically derived materials include Dobanol 23 (RTM) sold by Shell Chemicals (UK) Ltd., Ethyl 24 sold by the Ethyl Corporation, a blend of $C_{13}$–$C_{15}$ alcohols in the ratio 67% $C_{13}$, 33% $C_{15}$ sold under the trade name Lutensol by BASF GmbH and Synperonic (RTM) by ICI Ltd., and Lial 125 sold by Liquichimica Italiana. Examples of naturally occurring materials from which the alcohols can be derived are coconut oil and palm kernel oil and the corresponding fatty acids.

The alkyl ethoxy sulfate salts are preferably present in the compositions herein at levels of from 75% to 100% by weight of the anionic surfactant system. The anionic surfactant system may contain other types of surface-active agents, although in minor quantities; in particular, the present detergent compositions should contain less than 6% by weight of the total composition of alkyl benzene sulfonates and non-ethoxylated alkyl sulfates such as $C_{12-14}$ primary alkyl sulfate salts;

Other anionic co-surfactants which may be present in minor quantities in the present compositions include $C_{12}$–$C_{18}$ s-alkane sulfonates and alpha-sulphonated methyl fatty acid esters in which the fatty acid is derived from a $C_{12}$–$C_{18}$ fatty source.

Other suitable co-anionic surfactants suitable for the compositions herein are the alkali metal sarcosinates of formula $$R—CON(R)CH_2COOM$$

wherein R is a $C_9$–$C_{17}$ linear or branched alkyl or alkenyl group, R' is a $C_1$–$C_4$ alkyl group and M is an alkali metal ion. Preferred examples are the lauroyl, Cocoyl ($C_{12}$–$C_{14}$), myristyl and oleyl methyl sarcosinates in the form of their sodium salts.

The present compositions preferably also contain a nonionic surfactant in combination with the alkyl ethoxy sulfate salts herein;

Preferred nonionic surfactants for use herein are polyhydroxy fatty acid amides of the formula $$R^2—\underset{\underset{O}{\|}}{C}—\underset{\underset{R^1}{|}}{N}—Z,$$

wherein $R^1$ is H, $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain or mixtures thereof, and Z is derived from a reducing sugar such as glucose, fructose, maltose, lactose, in a reductive amination reaction. Preferred are $C_{12}$ or $C_{12-14}$ glucosamides.

Other preferred nonionic surfactants suitable for use herein include those produced by condensing ethylene oxide with a hydrocarbon having a reactive hydrogen atom, e.g., a hydroxyl, carboxyl, or amido group, in the presence of an acidic or basic catalyst, and include compounds having the general formula $RA(CH_2CH_2O)nH$ wherein R represents the hydrophobic moiety, A represents the group carrying the reactive hydrogen atom and n represents the average number of ethylene oxide moieties. R typically contains from about 8 to 22 carbon atoms. They can also be formed by the condensation of propylene oxide with a lower molecular weight compound. n usually varies from about 2 to about 24.

A preferred class of such nonionic ethoxylates is represented by the condensation product of a fatty alcohol having from 12 to 15 carbon atoms and from about 4 to 10 moles of ethylene oxide per mole or fatty alcohol. Suitable species of this class of ethoxylates include: the condensation product of $C_{12}$–$C_{15}$ oxo-alcohols and 3 to 9 moles of ethylene oxide per mole of alcohol; the condensation product or narrow cut $C_{14}$–$C_{15}$ oxo-alcohols and 3 to 9 moles of ethylene oxide per mole of fatty(oxo)alcohol; the condensation product of a narrow cut $C_{12}$–$C_{13}$ fatty(oxo)alcohol and 6.5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 4 to 8. The fatty oxo alcohols while mainly linear can have, depending upon the processing conditions and raw material olefins, a certain degree of branching, particularly short chain such as methyl branching. A degree of branching in the range from 15% to 50% (weight %) is frequently found in commercial oxo alcohols.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent compositions are disclosed in EP-B 0 070 074, 0 070 077, 0 075 996 and 0 094 118.

The surfactant system herein may also contain types of surfactants other than anionic and nonionic species.

Suitable cationic surfactants include quaternary ammonium compounds of the formula $R_1R_2R_3R_4N^+$ where $R_1$, $R_2$ and $R_3$ are methyl groups, and $R_4$ is a $C_{12-15}$ alkyl group, or where $R_1$ is an ethyl or hydroxy ethyl group, $R_2$ and $R_3$ are methyl groups and $R_4$ is a $C_{12-15}$ alkyl group.

Zwitterionic surfactants include derivatives of aliphatic quaternary ammonium, phosphonium, and sulfonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

The present concentrated detergent compositions typically contain from 25% to 45%, preferably 30% to 40% by weight of surfactant of which the weight ratio of anionic surfactant to nonionic surfactant is typically of 3:1 to 1:1, more preferably 2:1 to 1:1.

The compositions according to the present invention may further comprise a builder. Any conventional builder system is suitable for use herein including polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) $CH_2$(COOH) wherein R is $C_{10-20}$ alkyl or alkenyl, preferably $C_{12-16}$, or wherein R can be substituted with hydroxyl, sulfo sulfoxyl or sulfone substituents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium, ammonium, and alkanolammonium salts.

Other suitable polycarboxylates are oxodisuccinates and mixtures of tartrate monosuccinic and tartrate disuccinic acid such as described in U.S. Pat. No. 4,663,071.

Suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

A preferred builder system for use herein consists of a mixture of citric acid, fatty acids and succinic acid derivatives described hereinabove. The builder system according to the present invention preferably represents from 5% to 35% by weight of the total composition.

The compositions according to the invention preferably comprise enzymes. Suitable enzymes for use herein are protease, lipases, cellulases, and amylases and mixtures thereof.

The compositions according to the present invention may still advantageously comprise an enzyme stabilizing system, although at reduced levels as compared to compositions where alkyl benzene sulfonate and/or non-ethoxylated alkyl sulfate salts are present in majority. Any conventional enzyme stabilizing system is suitable for use herein, and preferred enzyme stabilizing systems are based on boric acid or derivatives thereof, 1,2-propanediol, carboxylic acids such as formic acid/formate, and mixtures thereof.

It has been found that the anionic surfactant system of the present invention provides improved stability of enzymes such as cellulase in presence of a protease.

The compositions herein can also advantageously contain a terephthalate-based soil release polymer at levels of from 0.05% to 2% of the total composition.

Such soil release polymers have been extensively described in the art, for instance in U.S. Pat. No. 4,116,885, U.S. Pat. No. 4,132,680, EP 185 427, EP 199 403, EP 241 985 and EP 241 984.

The compositions herein can contain a series of further optional ingredients. Examples of the like additives include solvents, alkanolamines, pH adjusting agents, suds regulants, opacifiers, agents to improve the machine compatibility in relation to enamel-coated surfaces, perfumes, dyes, bactericides, brighteners, softening agents and the like.

The present invention is further illustrated in the following examples.

EXAMPLES

The following compositions were prepared:

| | (weight % in formula) | |
|---|---|---|
| | example 1 | example 2 |
| C13–15 Alkyl 3 ethoxylated sulfate | 23 | 18 |
| C13–15 alcohol 7 ethoxylated | 6 | 5 |
| C12–14 N-methyl glucosamide | 9 | 9 |
| Builders | 16 | 17 |
| Ethanol | 2 | 2 |
| 1,2 Propane diol | 13 | 10 |
| Mono ethanolamine | 13 | 13 |
| Protease | 1.8 | 0.8 |
| Cellulase | 0.15 | 0.15 |
| Sodium Formate | — | 1.0 |
| Boric acid | 2.5 | 2.0 |
| Polyvinylpyrrolidone* | 0.5 | 0.5 |
| Water | 8 | 18 |
| Minors | to 100% | |

*Molecular weight 5000–15000, marketed under name GAFTEX, AE K15, by ISP

We claim:

1. A concentrated liquid detergent composition comprising the following:

(A) 25% to 35% of a surfactant component which comprises an anionic surfactant which consists of a water-soluble $C_{11}$–$C_{15}$ alkyl ethoxy sulfate containing an average per mole of from 1 to 9 ethoxy sulfates;

(B) 0.05% to 5% of a polyvinylpyrrolidone which has a molecular weight of 5,000 to 15,000;

(C) 2% to 8% water; and (D) a $C_{12}$ or $C_{12-14}$ glucose amide nonionic surfactant in an amount to provide a ratio of anionic surfactant to nonionic surfactant of 3:1 to 1:1.

2. A composition according to claim 1, which comprises from 0.25% to 2% by weight of the total composition of said polyvinylpyrrolidone.

3. A composition according to claim 1 wherein the alkyl ethoxy sulfate salt is a $C_{13}$–$C_{15}$ alkyl ethoxy sulfate with an average of two to three ethoxy groups per mole.

4. A composition according to claim 1 which further contains a protease enzyme and a cellulase enzyme.

* * * * *